US005927309A

United States Patent [19]

Hoover et al.

[11] Patent Number: 5,927,309

[45] **Date of Patent: *Jul. 27, 1999**

[54] CONTINUOUS-FLOW WARE WASHING APPARATUS

[75] Inventors: Richard D. Hoover; Walter J. Boryca, both of Troy; Gary V. Hoying, Sidney, all of Ohio

[73] Assignee: Premark FEG L.L.C., Wilmington, Del.

[ * ] Notice: This patent is subject to a terminal disclaimer.

[21] Appl. No.: 09/157,969

[22] Filed: Sep. 21, 1998

Related U.S. Application Data

[63] Continuation of application No. 08/992,754, Dec. 17, 1997, Pat. No. 5,810,036, which is a continuation of application No. 08/770,508, Dec. 20, 1996, Pat. No. 5,775,347.

[51] Int. Cl.[6] ..... S47L 15/16

[52] U.S. Cl. ..... 134/195; 134/199

[58] Field of Search ..... 134/56 R, 56 D, 134/57 R, 57 D, 104.3, 105, 107, 108, 191, 195, 198, 199, 89, 90, 188, 194

[56] References Cited

U.S. PATENT DOCUMENTS

| | | | |
|---|---|---|---|
| 392,517 | 11/1888 | King | 134/195 X |
| 659,278 | 10/1900 | Argerbright . | |
| 1,299,698 | 4/1919 | Fitzgerald . | |
| 1,479,661 | 1/1924 | Gates | 134/198 |
| 1,545,979 | 7/1925 | Rosenberg . | |
| 1,645,816 | 10/1927 | Murdoch | 134/191 X |
| 1,961,548 | 6/1934 | Caise . | |
| 2,066,232 | 12/1936 | Schmidt | 134/191 X |
| 2,287,591 | 6/1942 | Adams . | |
| 2,471,506 | 5/1949 | Wiswall | 134/199 X |
| 2,576,236 | 11/1951 | Paden . | |
| 2,630,813 | 3/1953 | Murdoch | 134/195 X |
| 2,651,311 | 9/1953 | Rule | 134/89 |
| 2,664,094 | 12/1953 | Spragins | 134/58 |
| 2,739,781 | 3/1956 | Lyman | 134/191 X |
| 3,020,918 | 2/1962 | Albertson et al. . | |
| 3,863,657 | 2/1975 | Irving | 134/57 |
| 4,773,436 | 9/1988 | Cantrell et al. | 134/108 |
| 5,660,194 | 8/1997 | Sanders et al. | 134/199 X |

FOREIGN PATENT DOCUMENTS

| | | | |
|---|---|---|---|
| 282239 | 6/1993 | European Pat. Off. . | |
| 1139218 | 6/1957 | France . | |
| 361049 | 11/1931 | United Kingdom | 134/199 |
| 929348 | 6/1963 | United Kingdom . | |
| 944917 | 12/1963 | United Kingdom . | |
| 1119873 | 7/1968 | United Kingdom . | |

*Primary Examiner*—Philip R. Coe
*Attorney, Agent, or Firm*—Thompson Hine & Flory LLP

[57] ABSTRACT

A continuous-flow warewashing apparatus that includes: a substantially rectangular tub having four side walls and a floor; a pump; a tub outlet channel coupled between the tub and the inlet port of the pump for providing fluid communication between the tub interior and the pump; and an array of outlet nozzles, where each of the outlet nozzles are in fluid communication with the outlet port of the pump and extend into the tub interior so as to provide a continuous-flow of washing fluid into the tub. A substantial portion of the outlet nozzles are positioned substantially along a first one of the side walls and pointed towards a second one of the side walls immediately adjacent to the first one of the side walls, such that the nozzles are adapted to jet fluid in a whirlpool-like manner substantially about the perimeter of the tub.

1 Claim, 9 Drawing Sheets

CONTINUOUS-FLOW WARE WASHING APPARATUS

CROSS REFERENCE TO RELATED APPLICATIONS

The present application is a continuation of U.S. patent application, Ser. No. 08/992,754, filed Dec. 17, 1997, now U.S. Pat. No. 5,810,036, which is a continuation of U.S. patent application, Ser. No. 08/770,508, filed Dec. 20, 1996, now U.S. Pat. No. 5,775,347.

BACKGROUND OF THE INVENTION

The present invention generally pertains to a continuous-flow warewashing apparatus, and more particularly, to a continuous-flow pot and pan washing apparatus adapted to create a substantial amount of whirlpool-like turbulence in the cleaning fluid held in the washing tub of the apparatus.

Multi-station pot and pan washing systems for use in restaurant or fast-food environments, typically include a scrapping station, a washing station having a washing tub, a rinse station having a rinse tub, and a sanitization station having a sanitization tub. The stations and tubs are typically coupled to each other on a frame and aligned against a far wall, where a worker or workers will manually transport the pots and pans from one station to the next.

Dirty pots and pans, etc. (hereinafter "cooking articles"), after being used for cooking/baking/frying/etc., will typically be substantially corroded and covered by layers of food by-product and grease. After scrapping excess food particles from the cooking articles at the scrapping station, the cooking articles are placed into the washing tub. In the washing tub, it is desirable to loosen the baked-on food by-product and grease particles from the cooking articles using a continuous-flow system which creates a high degree of turbulence within the washing fluids.

Several known continuous-flow washing tubs, for washing cooking articles, machinery, etc., exist that are designed to create a turbulence in the washing fluids present in the washing tub. These prior art systems typically include a pump for continuously circulating the washing fluids from an outlet port of the tub and back into the tub through a nozzle array or dispersion tube assembly. Examples of such prior-art systems can be found in U.S. Pat. No. 4,773,436 to Cantrell et al., U.S. Pat. No. 3,020,918 to Albertson et al., U.S. Pat. No. 2,651,311 to Rule, or U.S. Pat. No. 1,545,979 to Rosenberg.

One disadvantage with many prior art continuous-flow washing tubs is that the arrangement of the outlet nozzles, screens, and heating elements, etc. reduce the effective area within the washing tub interior that can be used to contain the cooking articles.

Another disadvantage with many prior art continuous-flow washing tubs is that the outlet nozzles or dispersion assemblies are arranged along one wall of the tub, at one vertical level and are oriented directly at the articles within the tub. Consequently, there is little chance that turbulent washing fluids will contact all of the articles contained within the tub. The turbulence of the washing fluid within the tub is likely to be significantly, and possibly adversely, affected by the presence of articles within the tub. Thus, when the nozzles and dispersement assemblies are oriented to direct the washing fluids directly at the articles within the tub, the articles nearest the nozzles or dispersement assemblies will immediately disrupt the flow of washing fluids within the tub, possibly eliminating significant flow of turbulent washing fluids to other parts of the tub.

Yet another disadvantage with prior art continuous-flow washing tubs is that the pump and pump motor are typically mounted such that maintenance of these components is difficult and awkward to perform. The positioning of prior art pumps often-times require the entire system to be moved away from the kitchen wall prior to such maintenance.

Accordingly, a need exists for a continuous-flow pot and pan washing tub that provides a maximum effective holding and working area within the tub, creates a turbulent washing fluid motion in the tub that is least likely to be effected by the presence of articles within the tub, and provides easy access for maintenance of the pump.

SUMMARY

The present invention provides a continuous-flow pot and pan washing system comprising a frame; a substantially rectangular tub mounted on the frame, where the side walls of the tub are shorter in length than the back and front walls of the tub; a pump mounted to the frame; a tub outlet channel coupled between the back wall of the tub and an inlet port of the pump, providing fluid communication between the tub interior and the pump; a manifold mounted to a first one of the sidewalls, having a manifold inlet coupled to, and a fluid communication with, the outlet port of the pump; and an array of outlet nozzles extending from the manifold, through the sidewall and into the tub interior, where a substantial portion of the outlet nozzles are angled towards one of the front or back walls such that the nozzles are adapted to jet fluid in a whirlpool-like manner substantially about the perimeter of the tub.

Preferably the nozzle array includes nozzles positioned at least two vertical levels. This assures that at least two vertical portions of the tub interior experience the whirlpool-like turbulence. It is also preferred that the nozzle array includes at least two vertical columns of nozzles and that the bottom-most rows of nozzles in the array are pointed substantially horizontally with respect to the floor. The uppermost nozzles are preferably angled downwardly with respect to the floor at an angle ranging from approximately 0° to 30°; and all of the nozzles are preferably angled towards the front or back wall at an angle ranging from approximately 5° to 45°.

The manifold is preferably integral with, the and recessed with respect to, the first sidewall, such that the nozzles do not extend into the effective area of the tub as defined by the area within the intersecting planes of the front, back and sidewalls of the tub. Therefore, because the outlet nozzles are recessed with respect to the effective area of the tub, the outlet jets of washing fluid are less likely to be immediately affected by the presence of articles within the tub. This positioning of the nozzles is also safer for the user, as it is less likely that the user will come into contact with the nozzles while working in the tub.

The washing tub also preferably includes rectangular recess extending into one of the tub walls to provide a substantially turbulent-free bay within the tub interior. A fluid level sensor and a heating element extend into the bay and operate without significant interference from the turbulence created by the nozzles. Because the heating element is recessed from, and screened off from, the effective area of the tub, a safer and larger effective washing area is provided.

Finally, the preferred embodiment of the system includes a centrifugal pump mounted to the first sidewall of the warewashing machine. The pump includes a motor, a drive shaft rotatably driven by the motor, and an impeller mounted to the drive shaft. The pump is oriented such that the drive shaft extends substantially parallel to the corresponding first sidewall. The impeller is positioned adjacent to the back wall and the motor is positioned adjacent to the front wall. Therefore, the pump motor is easily accessible and maintainable from the front of the warewashing apparatus.

Accordingly, it is an object of the present invention to provide a pot and pan washing machine which maximizes the effective washing area within the washing tub; which provides turbulent washing fluid to every article contained within the washing tub, and which is easily maintained and operated.

It is also an object of the present invention to provide a continuous-flow warewashing apparatus that includes: a substantially rectangular tub including four side walls and a floor; a pump; a tub outlet channel coupled between the tub and the inlet port of the pump for providing fluid communication between the tub interior and the pump; and an array of outlet nozzles in fluid communication with the outlet port of the pump and extending from a first one of the side walls into the tub interior, adapted to jet fluid into the tub interior; where a substantial portion of the outlet nozzles are pointed towards a second one of the side walls, adjacent to the first one of the side walls, such that the nozzles are adapted to jet fluid in a whirlpool-like manner substantially about the perimeter of the tub.

It is also an object of the present invention to provide a continuous-flow warewashing apparatus that includes: a substantially rectangular tub having four side walls and a floor; a pump; a tub outlet channel coupled between the tub and the inlet port of the pump for providing fluid communication between the tub interior and the pump, where the tub outlet channel has a mouth opening the tub interior; a recess extending into one of the side walls to form a recessed area within the tub interior, outside of the perimeter formed by the four side walls; at least one outlet nozzle in fluid communication with the outlet port of the pump and extending into the tub interior so as to provide a continuous flow of washing fluid into the tub interior; a fluid-level sensor positioned within the tub interior; and a heating coil positioned within the tub interior; where at least one of the outlet nozzle, fluid-level sensor, or heating coil is positioned in the recessed area so that effective working and holding area within the tub is increased.

It is also an object of the present invention to provide a continuous-flow warewashing apparatus that includes: a substantially rectangular tub having four side walls and a floor; a pump; a tub outlet channel coupled between the tub and the inlet port of the pump for providing fluid communication between the tub interior and the pump, where the tub outlet channel has a mouth opening into the tub interior; at least one outlet nozzle in fluid communication with the outlet port of the pump and extending into the tub interior so as to provide a continuous-flow of washing fluid into the tub; and a recess extending into one of the side walls to provide a substantially turbulent free bay within the interior, outside of perimeter formed by the four side walls. It is a further object of the present invention to position a fluid-level sensor or a heating element in the bay.

It is also an object of the present invention to provide a continuous-flow warewashing apparatus that includes: a substantially rectangular tub having four side walls and a floor; a pump; a tub outlet channel coupled between the tub and the inlet port of the pump for providing fluid communication between the tub interior and the pump; a recess extending into one of the side walls forming an recessed area within the tub interior, outside of the perimeter formed by the four side walls; and at least one outlet nozzle in fluid communication with the outlet port of the pump and extending into the recessed area so as to provide a continuous flow of washing fluid into the tub interior.

It is also an object of the present invention to provide a continuous-flow warewashing apparatus that includes: a substantially rectangular tub having two side walls, a front wall, a back wall and a floor; a pump; a tub outlet channel coupled between the tub and the inlet port of the pump for providing fluid communication between the tub interior and the pump, where the tub outlet channel has a mouth opening into the tub interior; and at least one outlet nozzle in fluid communication with the outlet port of the pump and extending into the tub interior so as to provide a continuous-flow of washing fluid into the tub; where the pump is a centrifugal pump having a motor, a drive shaft rotatably driven by the motor, and an impeller mounted to the drive shaft; and where the pump is mounted to the warewashing apparatus such that the drive shaft extends substantially parallel to one of the side walls, such that the impeller is positioned adjacent to the back wall and such that the motor is positioned adjacent to the front wall, so that the pump motor is easily accessed and maintained from the front of the warewashing apparatus.

These and other objects and advantages of the present invention will be apparent from the following description, the attached drawings and the appended claims.

DETAILED DESCRIPTION OF THE INVENTION

Figure 1:
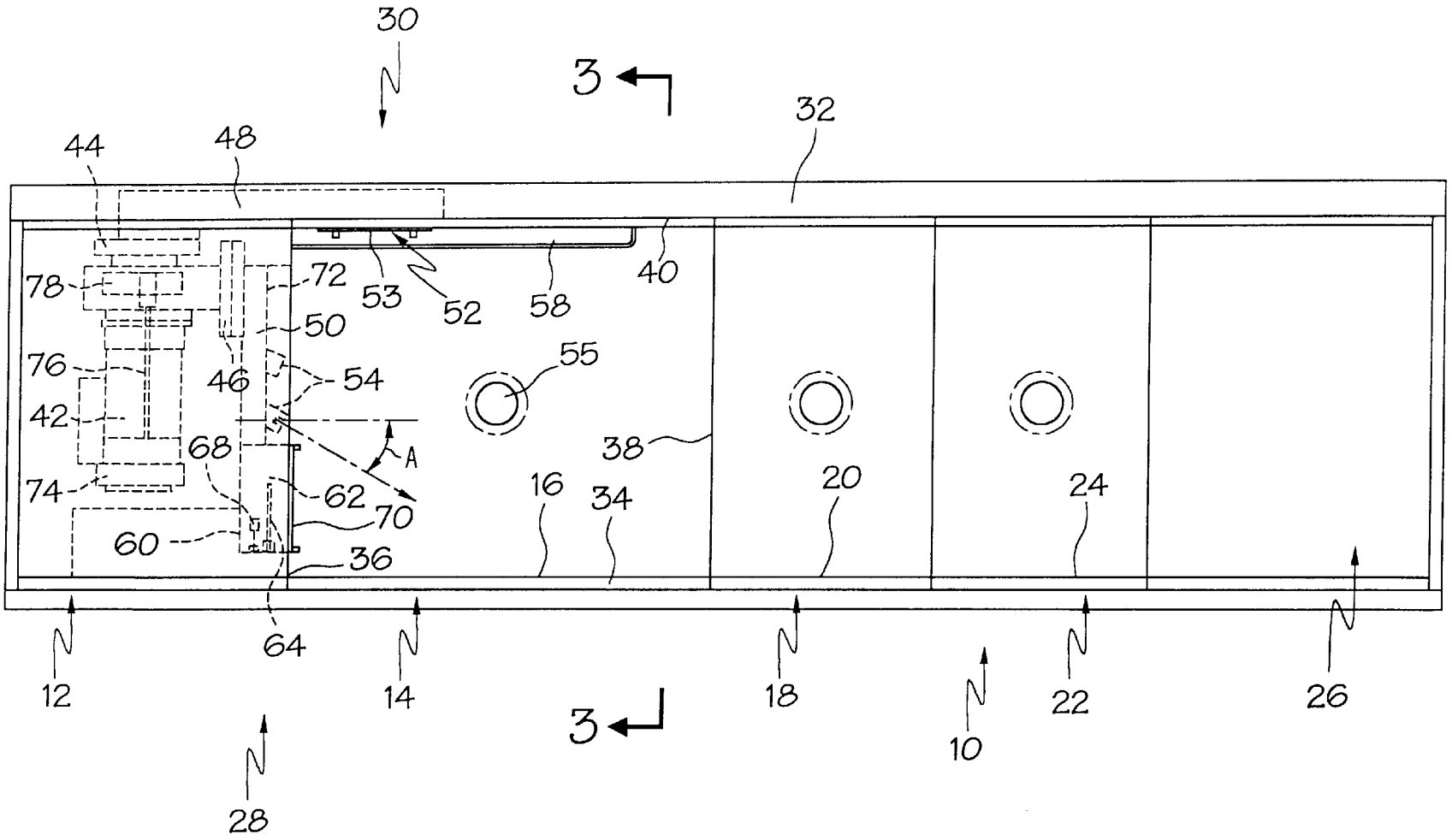
FIG. 1 is a top view of a multi-station pot and pan washing apparatus for use with the present invention.
Figure 2:
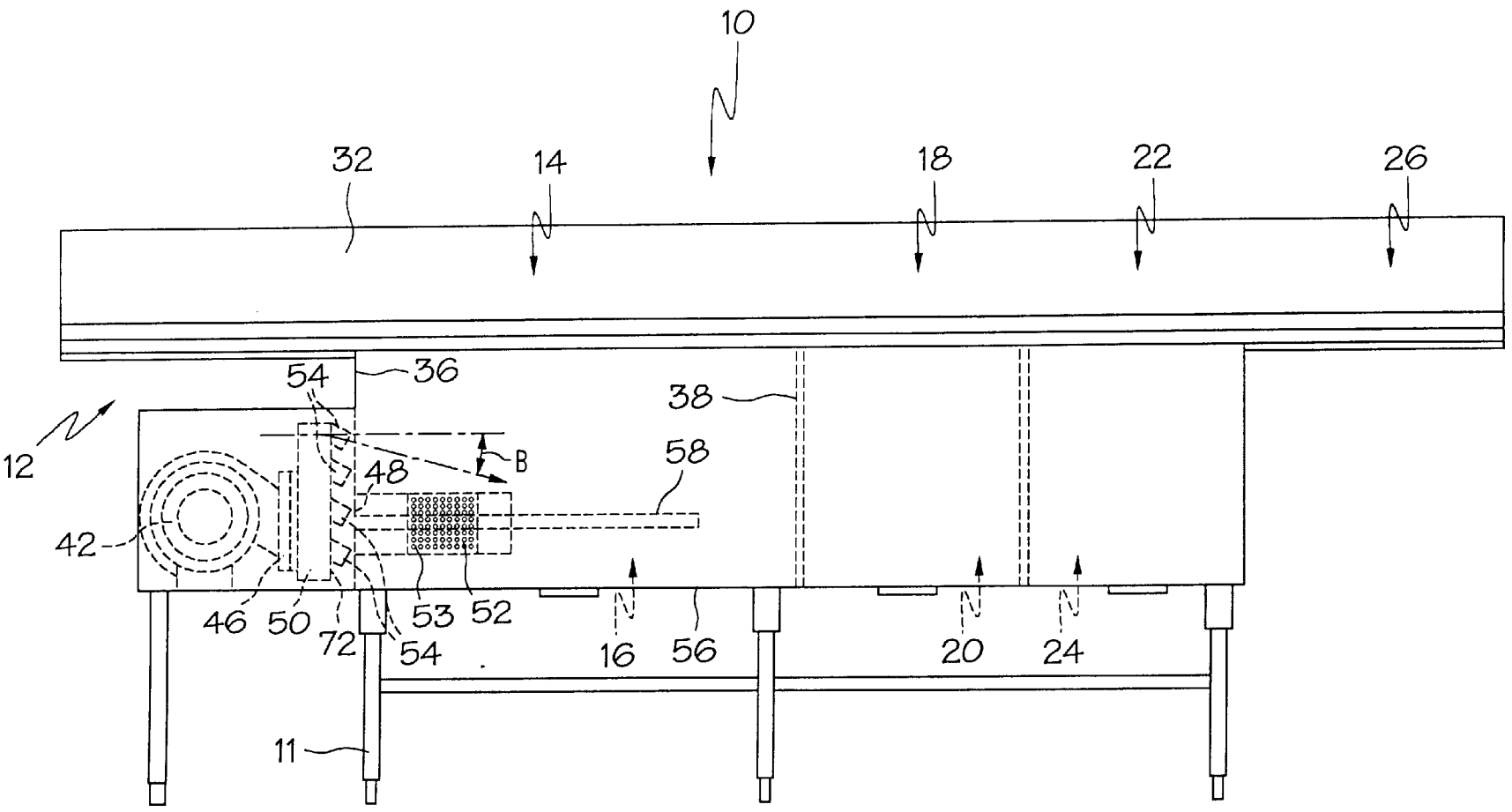
FIG. 2 is a front view of the multi-station pot and pan washing apparatus for use with the present invention.

As shown in FIGS. 1 and 2, the typical multi-station washing apparatus 10 will consist of a frame 11, a scrapping station 12, a washing station 14 having a washing tub 16, a rinsing station 18, having a rinsing tub 20, a sanitizing station 22 having a sanitization tub 24, and a stacking or drying station 26. Such a washing system can be used as follows: at the scrapping station 12, the dirty cooking articles are scraped to remove the large and loose food by-product particles therefrom. Next, the user places the cooking articles into the washing tub 16 which is filled with a soapy fluid that circulates around the perimeter of a tub in a whirlpool-like flow as will be described below. Once the dirty cooking articles have soaked within the turbulent soapy fluid of the washing tub 16 for a predetermined amount of time, sufficient for the baked or fried on food by-product particles or grease to soften or release from the particular articles, the user may then use a brush or a scouring pad to remove the remaining food by-product or grease particles from the cooking articles. Once the cooking articles are sufficiently clean, they are then rinsed within the rinsing tub 20 (filled with a rinsing fluid such as water) and sanitized in the sanitization tub 24 (filled with a sanitizing agent). Once properly sanitized, the cleaned cooking articles are stacked or dried at the drying station 26.

The front 28 of the washing apparatus 10 is typically where the user stands while working, and the back 30 of washing apparatus, which includes a splash guard 32, is typically positioned against a wall of the room to provide an efficient use of space within the room. Although the washing apparatus 10 is shown as having the particular stations arranged in a left-to-right manner, it will be apparent to one of ordinary skill in the art that the particular stations can be arranged in a right-to-left manner.

As shown in FIGS. 1 and 2 the washing tub 16 includes a front wall 34, two oppositely facing sidewalls 36, 38 and a back wall 40. The sidewalls 36, 38 are typically shorter than the front and back walls 34, 40. This is because the user should always be able to reach to the back of the tub, limiting the available length for the sidewalls.

A pump 42 is mounted to the frame 11 adjacent the sidewall 36 (the outer-most sidewall of this embodiment) of the washing tub and has an inlet port 44 and an outlet port 46. The pump acts to pump the washing fluids continuously from the tub 16, through an outlet channel 48, through the pump 42, into a manifold 50, and back into the tub 16 via nozzles 54 extending from the manifold 50 as is described in detail below. The outlet channel of the tub 48 has a outlet mouth 52 for providing fluid communication between the interior of the tub and the outlet channel 48, and the outlet mouth 52 is covered by a screen 53 mounted to the back wall. The tub also includes floor 56, having a drain 55 centrally positioned in the floor for draining the washing fluids from the tub.

As mentioned above, the manifold 50 includes an array of nozzles 54 for jetting the washing fluid into the tub 16 at high velocities, causing a desired whirlpool-like turbulence within the tub 16. As shown in FIG. 1, the nozzles 54 are angled towards the front wall 34 at an angle A which is preferably approximately 30°; and as shown in FIG. 2, the nozzles 54 are also preferably angled downwardly towards the floor 56 of the tub at an angle B which is preferably approximately 15°. It is also within the scope of the invention that the angle A can range from 5° to 45°; and the angle B can range from 0° to 30°.

Figure 6:
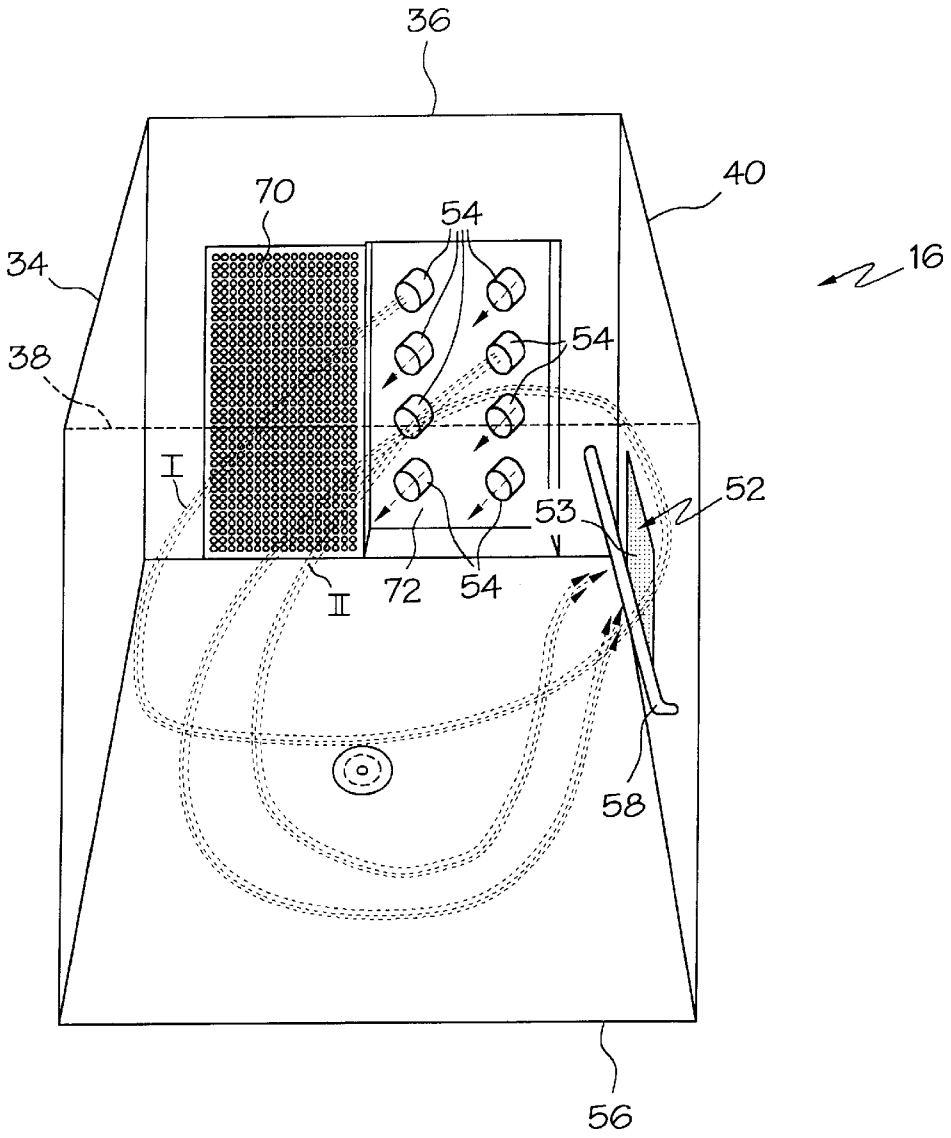
FIG. 6 is a prospective side view of the present invention depicting the whirlpool-like flow of the washing fluids within the washing tub.

As shown in FIG. 6, the orientation of the nozzles 54 cause a whirlpool-like flow within the washing tub 16 as shown arrows I and II. Because this flow initially starts out as pointed from the sidewall 36 towards the front wall 34, and not directed directly towards the interior of the tub, the initial flow of washing fluid from the nozzles is not likely to immediately contact any cooking articles present within the tub, and thus there is a better chance for the whirlpool-like flow to be established. The whirlpool-like flow around the perimeter of tub, as defined by the front, back and side walls, acts to provide a turbulent flow of washing fluid to every article contained within the tub. As the flow passes by an article the characteristics of the whirlpool-like flow allows many smaller eddies to separate or taper off from the main whirlpool flow as it flows around the perimeter of the tub. These eddies provide the turbulent flows of washing fluids to portions of the tub and to cooking articles not positioned near the main whirlpool flow.

As shown in FIG. 6, the positioning of the outlet mouth 52, approximate to the sidewall 36 and floor 56 of the tub, further facilitates the whirlpool-like flow within the tub. The pump is preferably pumping fluids at approximately 300 gallons per minute, causing a substantial suction to be created at the outlet mouth 52. The location of this suction, at the end of the whirlpool flow cycle, maintains the whirlpool-like flow within the tub.

Figure 3:
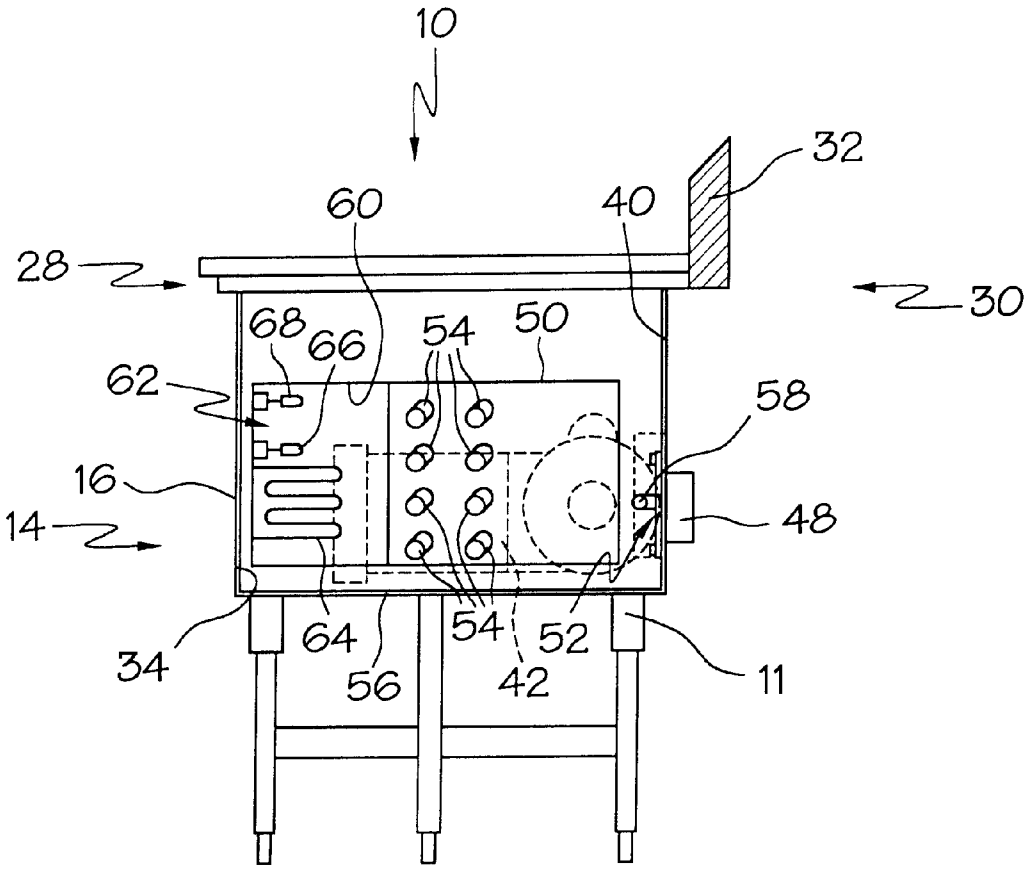
FIG. 3 is a cross-sectional view of the multi-stationed pot and pan washing apparatus taken along lines 3—3 of FIG. 1, and showing the inside wall of the manifold and the array of outlet nozzles extending from the manifold.

The embodiment of the invention as shown in FIGS. 1, 2 and 3 includes two vertical columns of four nozzles 54; the nozzles being vertically spaced in each column such as to provide a whirlpool-like turbulence flow in the washing tub at corresponding vertical levels within the washing tub. It should be apparent to one of ordinary skill in the art that while two vertical columns of nozzles are disclosed in the present invention, there are numerous arrangements of nozzles which can provide the desired whirlpool like flow of the washing fluid within the washing tub. Nevertheless, it is preferable that there is at least two vertical levels of nozzles within the washing tub, corresponding to at least two vertical levels of the whirlpool like flow created by the nozzles within the washing tub.

Figure 5:
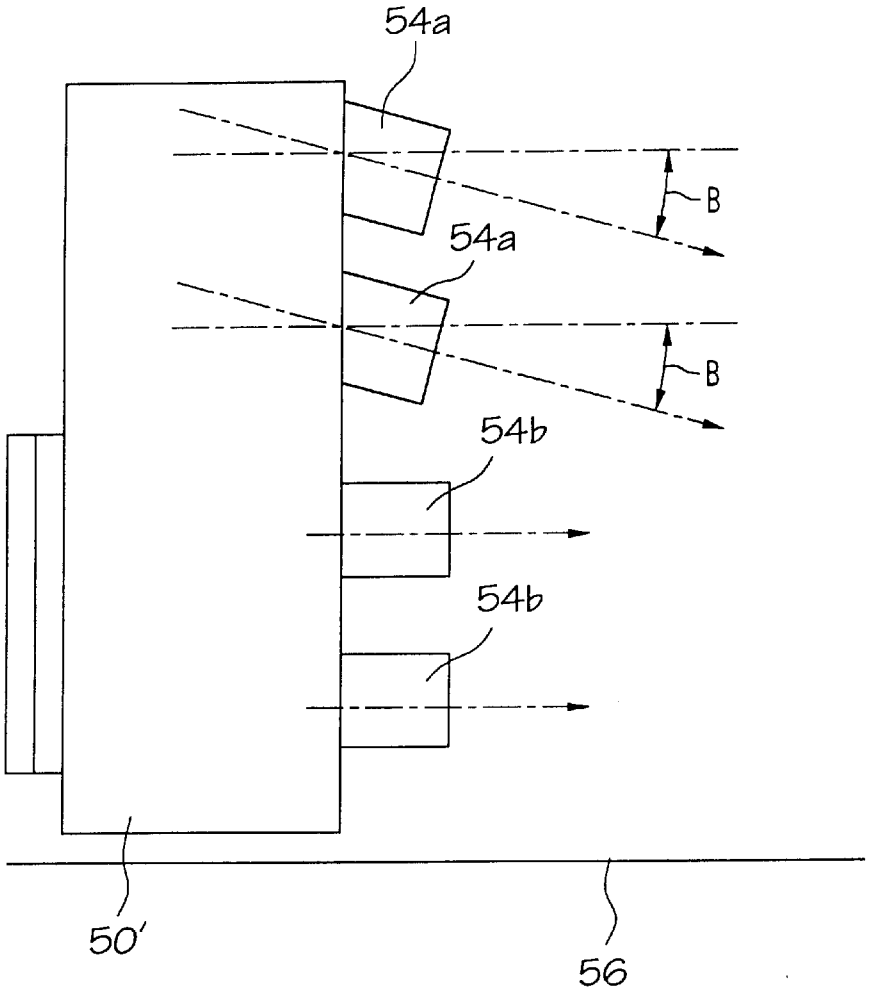
FIG. 5 is a side view of an alternate embodiment of the manifold for use with the present invention.

Furthermore, it is not necessary that every nozzle is angled downwardly. But it is preferable that at least the upper-most nozzles be angled downwardly towards the floor to assist in avoiding washing fluid from splashing out of the tub while in use. For example, as shown in FIG. 5, one embodiment of the manifold 50' includes two upper-most vertical rows of nozzles **54*a* angled downwardly towards the floor 56 of the tub at an angle B, and two bottom-most rows of nozzles 54*b* angled substantially horizontally with respect to the floor 56** of the tub.

As shown in FIGS. 1–3 and 6, a bar 58 is mounted to both the sidewall 36 and the back wall 40. The bar extends horizontally from the sidewall 36, across the screen 53, and horizontally along a substantial length of the back wall 40. The bar 58 curves back into the back wall at its distal end. This bar 58 preferably extends horizontally over 26 inches of the back wall such that it is longer than any article which is to be placed within the washing tub. The bar 58 operates to prevent cavitation from occurring in the pump by preventing the articles within the tub from being sucked directly up against the screen 53 and blocking the outlet mouth 52.

As shown in FIGS. **9*a*–9*c*, an alternate embodiment of the screen 53' includes an array of five horizontally extending bars 58'** mounted directly to the screen in a staggered formation.

As shown in FIGS. 1 and 3, the tub 16 includes a rectangular recessed portion 60 which is recessed with respect to the sidewall 36 to form a bay area 62 within the tub (this recessed portion is not shown in FIG. 2 such that the manifold and nozzle arrangement can be clearly displayed). Because the bay area 62 is recessed with respect to the effective area of the tub (as defined by the four walls of the tub) it creates a substantially turbulent free zone within the tub interior. Consequently, a heating element 64 and a pair of fluid-level sensors 66 and 68 are extended into the bay area 62. The lower fluid-level sensor 66 is positioned above the heating element and determines when the level of fluid extends above the heating element 64, thus providing a fluid-level signal to a control mechanism (not shown) which, in response to the fluid-level signal, knows that the heating element 64 may be safely activated. The second fluid-level sensor 68 is positioned above the vertical level of the nozzles 54 and determines when the level of fluid extends above the nozzles 54, thus providing a second fluid-level signal to the control mechanism which, in response to the second fluid-level signal, knows that the pump 42 may be safely activated. Preferably the fluid level sensors 66, 68 are "floats".

As shown in FIGS. 1 and 6, a screen 70 is mounted to the sidewall 36 over the bay area 62 formed by the recess 60, and prevents the user's hands from contacting the heating element 64 (the screen 70 is not shown in FIG. 3 to provide a clear view of the heating element 64 and fluid-level sensors 66, 68).

As shown in FIGS. 1, 2 and 6, the manifold 50 has an inside wall 72 from which the nozzles 54 extend. This inside wall 72 of the manifold is preferably recessed with respect to the sidewall 36, such that the nozzles 54 do not extend pass the vertical plane defined by the sidewall 36. Because the outlet nozzles 54 are recessed with respect to the effective area of the tub, the outlet jets of washing fluid are less likely to be immediately affected by the presence of articles within the tub 16. This positioning of the nozzles is also safer for the user, as it is less likely that the user will come into contact with the nozzles while working in the tub.

Figure 8A:
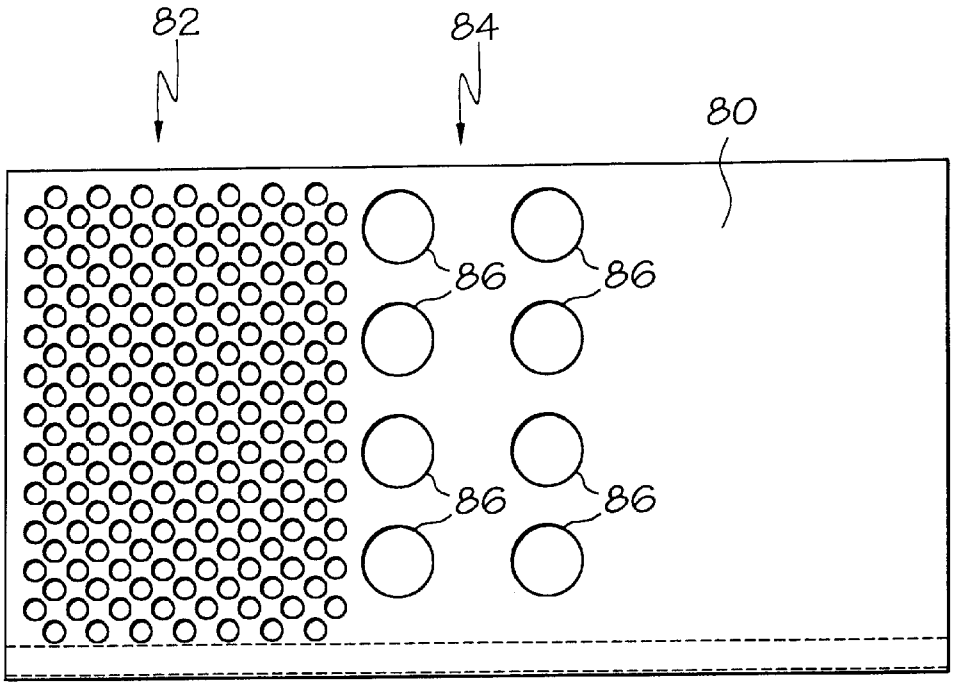
FIG. 8*a* is a front view of a side panel for covering the bay and recessed nozzles of the present invention.
Figure 8B:
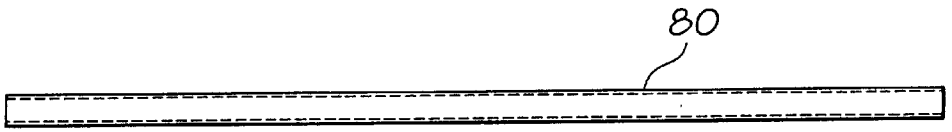
FIG. 8*b* is a top view of the side panel.
Figure 8C:
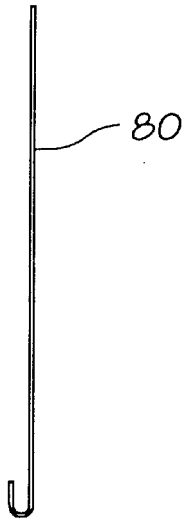
FIG. 8*c* is a side view of the side panel.
Figure 9A:
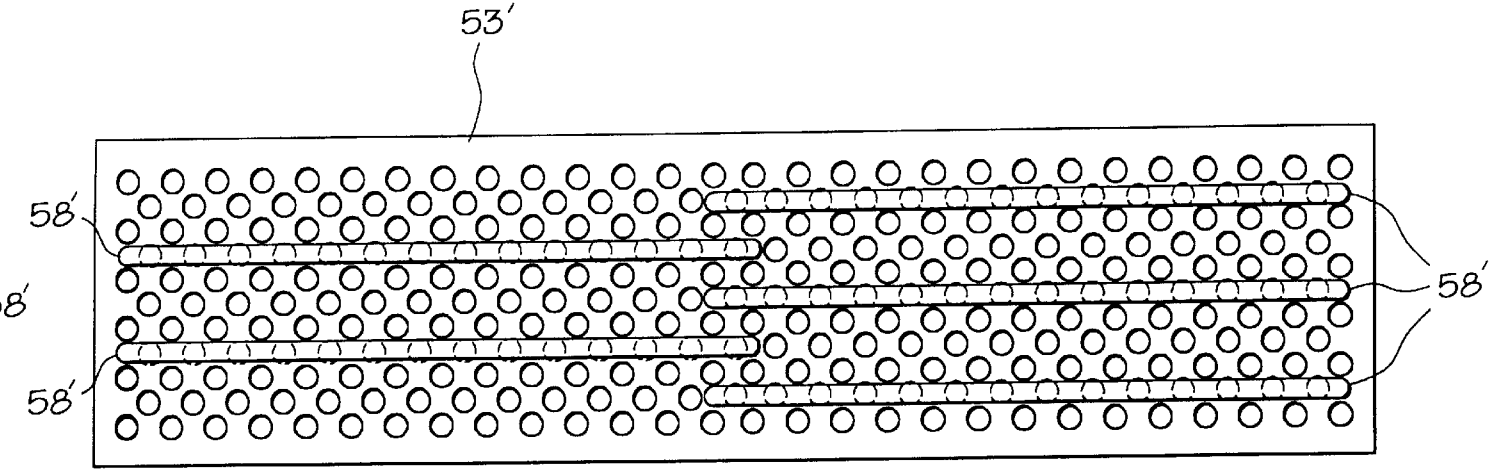
FIG. 9*a* is a front view of an alternate embodiment of a screen for covering the outlet mouth of the washing tub.
Figure 9B:
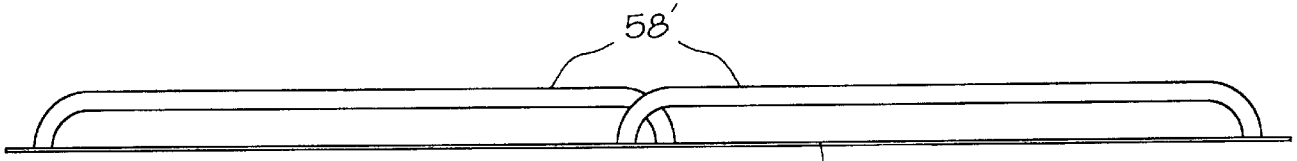
FIG. 9*b* is a top view of the alternate screen embodiment.
Figure 9C:
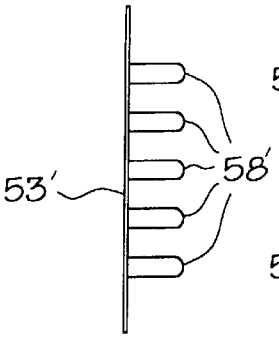
FIG. 9*c* is a side view of the alternate screen embodiment.

As shown in FIGS. 8*a–c*, a panel 80 can be used in place of the screen 70. The panel 80 includes a screen portion 82, for covering the bay area 62 (as shown in FIG. 3). The panel also includes a nozzle panel portion 84, having nozzle outlet apertures 86, for covering the manifold 50 and recessed nozzles 54 (as shown in FIG. 3).

The length of the front and back walls 34, 40 of the tub 16, as shown in FIGS. 1–3 and 6, are between 30 inches to 42 inches. Furthermore, in this embodiment, the nozzles 54 are approximately 13/16" in diameter, the inlet mouth 52 is approximately 147 square inches and the pump 42 pumps the washing fluid at approximately 300 gallons-per-minute.

Figure 4:
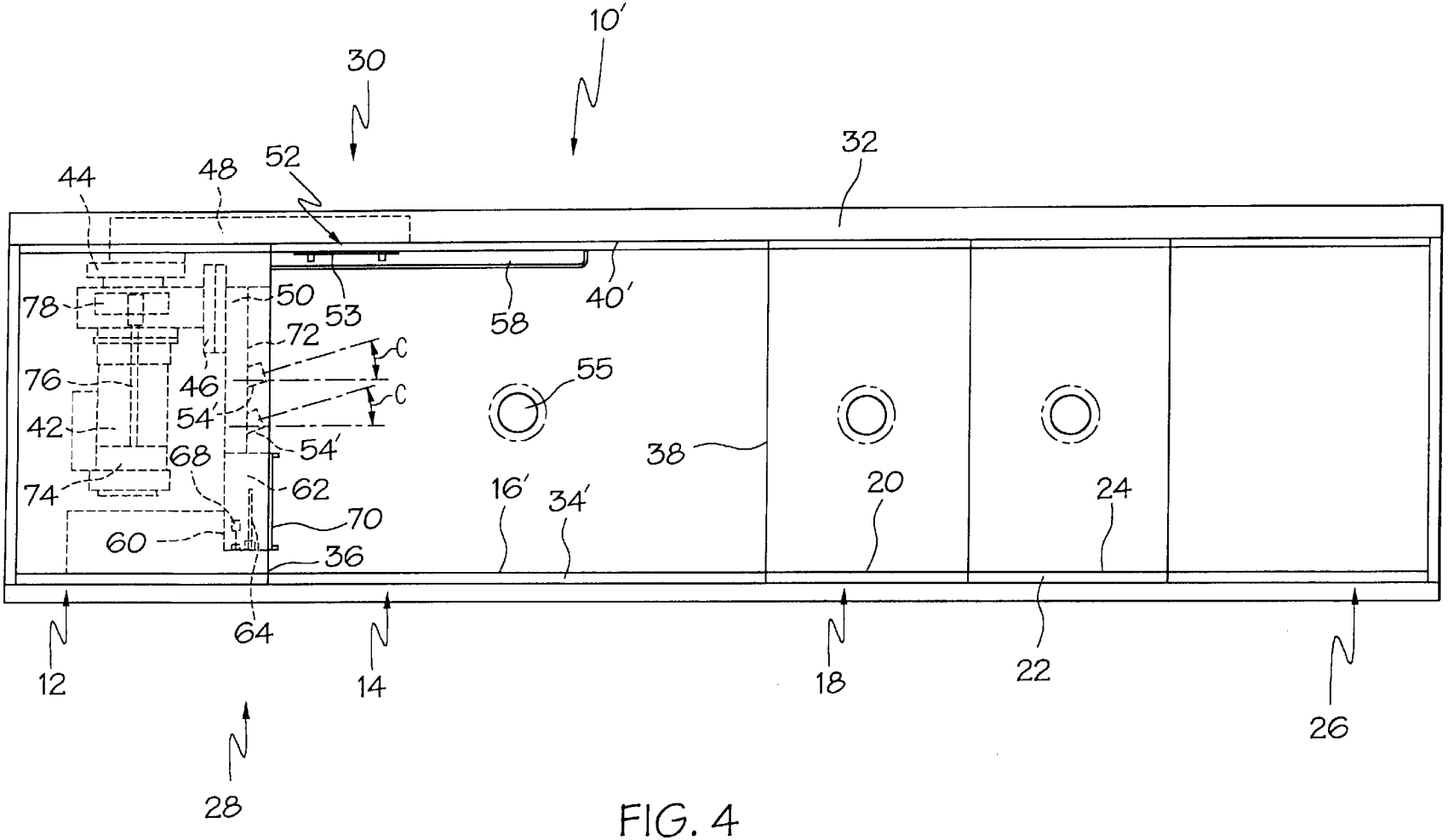
FIG. 4 is a top view of an alternate embodiment of the present invention as incorporated into a multi-station pot and pan washing apparatus.

An alternate embodiment of the present invention, as shown in FIG. 4, utilizes a different nozzle arrangement for a longer wash tub 16'; i.e. the back wall 40' and the front wall 34' are longer. In this embodiment, the nozzle arrays have nozzles 54' which are angled backwards towards the back wall 40 at an angle C which is approximately 15°. The capacity and power of the pump 42 preferably remains the same and the outlet mouth 52 preferably has the same dimensions. But the diameter of the nozzles 54' are smaller, approximately 5/8" in diameter, such that the velocity of the water being jetted therefrom is significantly greater than the first embodiment. Accordingly, the higher speed water fluid jetting from the nozzles 54' is jetted in such a velocity that the flow bypasses the mouth 52 without a significant portion of the fluid being diverted from the whirlpool-like path.

Figure 7:
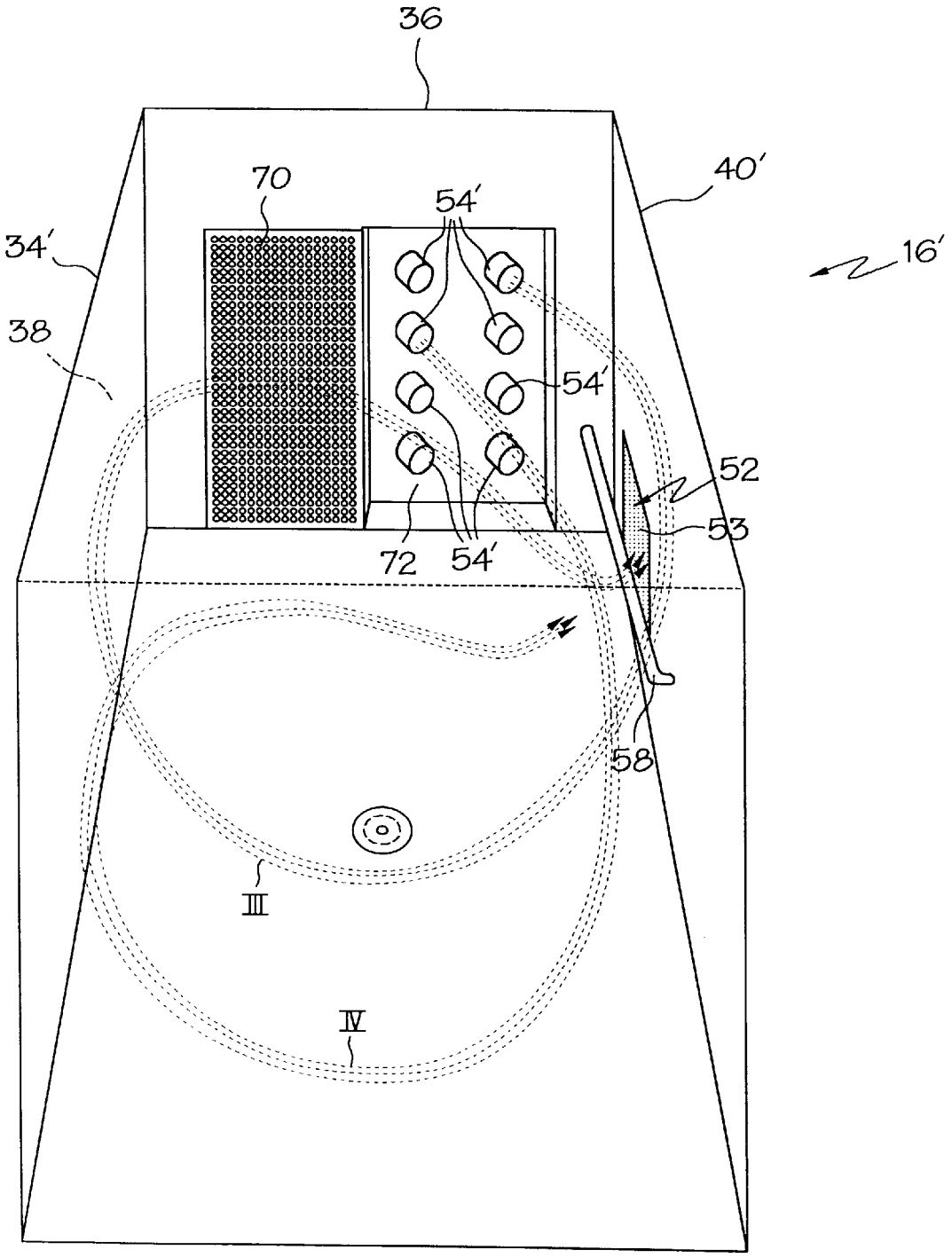
FIG. 7 is prospective side view of the alternate embodiment of the present invention depicting the whirlpool-like flow of the washing fluids within a long washing tub.

As shown in FIG. 7, the nozzle arrangement in this alternate embodiment produces a whirlpool-like flow within the tub 16' as shown by arrows III and IV. Because this flow initially starts out as pointed from the sidewall 36 towards the back wall 40', and not directed directly towards the interior of the tub, the initial flow of washing fluid from the nozzles is not likely to immediately contact any cooking articles present within the tub, and thus there is a better chance for the whirlpool-like flow to be established. The whirlpool-like flow around the perimeter of tub, as defined by the front, back and side walls, acts to provide a turbulent flow of washing fluid to every article contained within the tub. As the flow passes by an article the characteristics of the whirlpool-like flow allows many smaller eddies to separate or taper off from the main whirlpool flow as it flows around the perimeter of the tub. These eddies provide the turbulent flows of washing fluids to portions of the tub and to cooking articles not positioned near the main whirlpool flow.

As shown in FIG. 7, the positioning of the outlet mouth 52, approximate to the sidewall 36 and floor 56 of the tub, further facilitates the whirlpool-like flow within the tub. The pump is preferably pumping fluids at approximately 300 gallons per minute, causing a substantial suction to be created at the outlet mouth 52. The location of this suction, at the end of the whirlpool flow cycle, maintains the whirlpool-like flow within the tub.

In each embodiment, the pump 42 is preferably a centrifugal pump having a motor 74 which rotatably drives a drive shaft 76, the drive shaft being coupled to, and in turn rotatably driving an impeller 78. The pump 42 is preferably mounted on the frame 11 such that the drive shaft 76 extends substantially parallel to the sidewall 36, such that the motor 74 is positioned approximate the front 28 of the warewashing apparatus 10 and such that the impeller is positioned approximate the back 30 of the warewashing apparatus. Therefore the mounting of the pump 42 facilitates easy access and maintainability of the pump 42 from the front 28 of the warewashing apparatus.

Having described the invention in detail and by reference to the drawings, it will be apparent that modification and variations are possible without departing from the scope of the invention as defined in the following claims.

What is claimed is:

1. A continuous-flow warewashing apparatus, comprising:

a substantially rectangular tub having a tub interior, and including four side walls and a floor, the side walls forming a perimeter;

a pump including an inlet port and an outlet port;

a tub outlet channel coupled between the tub and the inlet port of the pump for providing fluid communication between the tub interior and the pump; and an array of outlet nozzles, each of the outlet nozzles being in fluid communication with the outlet port of the pump and extending into the tub interior so as to provide a continuous-flow of washing fluid into the tub;

a substantial portion of the outlet nozzles being positioned substantially along a first one of the side walls and pointed towards a second one of the side walls immediately adjacent to the first one of the side walls, such that the nozzles are adapted to jet fluid in a whirlpool-like manner substantially about the perimeter.

* * * * *